US007692523B2

(12) United States Patent
Colmenero et al.

(10) Patent No.: US 7,692,523 B2
(45) Date of Patent: Apr. 6, 2010

(54) MULTI-VOLTAGE POWER TRANSFORMER FOR THE HIGH-VOLTAGE ELECTRICITY TRANSMISSION NETWORK

(75) Inventors: Alberto Prieto Colmenero, Cordoba (ES); Miguel Oliva Navarrete, Cordoba (ES)

(73) Assignee: Asea Brown Boveri, S.A. (ES)

( * ) Notice: Subject to any disclaimer, the term of this patent is extended or adjusted under 35 U.S.C. 154(b) by 60 days.

(21) Appl. No.: 11/187,316

(22) Filed: Jul. 22, 2005

(65) Prior Publication Data

US 2006/0017537 A1 Jan. 26, 2006

(30) Foreign Application Priority Data

Jul. 22, 2004 (ES) ..... 200401849

(51) Int. Cl.
*H01F 30/12* (2006.01)

(52) U.S. Cl. ..... 336/5; 336/150; 323/43.5 R

(58) Field of Classification Search ..... 336/5
See application file for complete search history.

(56) References Cited

U.S. PATENT DOCUMENTS

| | | | | |
|---|---|---|---|---|
| 1,896,398 | A | | 2/1933 | Gay |
| 2,020,941 | A | | 11/1935 | Guhl |
| 2,246,318 | A | * | 6/1941 | Putman ..... 361/39 |
| 2,883,612 | A | * | 4/1959 | De Buda ..... 323/342 |
| 3,560,843 | A | * | 2/1971 | Nakagawa et al. ..... 323/342 |
| 3,855,521 | A | | 12/1974 | Kiuchi |
| 4,047,139 | A | * | 9/1977 | Fukuda et al. ..... 336/150 |
| 4,441,149 | A | | 4/1984 | Hase |
| 4,611,190 | A | | 9/1986 | Montague |
| 2003/0234639 | A1 | | 12/2003 | Ahuja et al. |

* cited by examiner

*Primary Examiner*—Elvin G Enad
*Assistant Examiner*—Joselito Baisa
(74) *Attorney, Agent, or Firm*—Pepper Hamilton LLP

(57) ABSTRACT

A multi-voltage power transformer for the high-voltage electricity transmission network, has a compact design and has different selectable voltage levels at the input and/or output.

21 Claims, 5 Drawing Sheets

MULTI-VOLTAGE POWER TRANSFORMER FOR THE HIGH-VOLTAGE ELECTRICITY TRANSMISSION NETWORK

RELATED APPLICATIONS AND CLAIM OF PRIORITY

This application claims priority to Spain patent application no. P200401849, filed Jul. 22, 2004, entitled "Multi-Voltage Power Transformer for the High-Voltage Electricity Transmission Network (Polytransformer)."

TECHNICAL FIELD

The present invention is related to the transmission and transformation of high-voltage electrical power. More specifically, in an embodiment, the invention relates to a high voltage power transformer which can be used in multiple applications requiring different input, output and/or tertiary winding voltage values.

BACKGROUND

Voltage and current transformation components to facilitate the transmission of electricity from power generation facilities to end users have been known and used for a long time in the electrical power sector.

The transmission of electrical power requires high voltage levels to reduce current intensity and, therefore, minimize energy loss associated with transmission. Thus, the transmission of electrical power is more efficient at high voltage levels, while its consumption requires a low-voltage system for safety reasons. At various points in the transmission network, substations may be installed to receive electricity and route it to different transmission and/or distribution systems. In the substations of the transmission system, transformers may be employed to modify current and/or voltage values in order to optimize both the transmission of electrical power and the provision of the service which is performed with it.

In fixed installations, there are transformers adjusted to the precise levels, meaning that they are designed with fixed input and output voltage values to permanently perform their job. In the event of a fault or other similar contingency, the transformer must be removed from service and replaced until the original situation can be restored. Because of the size and weight of these components, transporting and moving spare equipment is not easily done, requiring special transporting systems and means. Furthermore, there must be as many different spare-units as necessary to deal with the different input and output values of the various transformers that exist in power transmission networks. For a power generation or transmission system, the requirement to store spare transformers can be very expensive, and transporting spare transformers from one location to another may be infeasible. Accordingly, power companies may be forced to wait until a faulty transformer can be repaired or a new transformer can be built. In such cases, long outage periods can seriously strain the power transmission network.

Accordingly, it is desirable to provide a high voltage power transformer that can be used in multiple locations with different input and/or output voltage values, with shipping dimensions that allow for movement from one location to another. The disclosure contained herein describes attempts to solve one or more of the problems described above.

SUMMARY

In an embodiment, a high voltage transformer includes a series winding and a common winding, a high voltage output terminal, a low voltage output terminal, and one or more taps positioned along at least one of the windings so that the taps, when selected, cause at least one of the terminal voltages to correspond to a desired voltage level. The transformer may be a single-phase autotransformer, or it may be a three-phase autotransformer having windings, taps and bushings for each phase. The transformer may include a housing that holds the winding and at least a portion of a cooling system, wherein the housing is sized within a maximum dimension that is suitable for rail transport in a desired geographic area. The cooling system may include oil and fans or other heat exchangers that cool the oil.

In an embodiment, the transformer may include a removable bushing for each high voltage terminal and each low voltage terminal. The housing may include at least one access area that provides access to tap leads that permit selection of the taps.

The transformer may also include a regulating winding and a tap changer that selects a tap position along the regulating winding. Further, it may include a tertiary winding, which may include one or more taps that permit adjustment of tertiary winding voltage.

In an embodiment, the transformer may be an autotransformer having a power rating of at least about 100 MVA and an output voltage of at least about 69 kV.

In an alternate embodiment, a multi-voltage, high voltage autotransformer having a plurality of selectable input or output voltage levels and removable components such that, when the removable components are removed, the autotransformer is sized to permit transport within applicable railway dimension and weight limitations. The removable components may include at least one high voltage input bushing and at least one high voltage output bushing. The autotransformer may also include a series or common winding with a plurality of taps such that the selection of a tap along the winding will select the input voltage level or the output voltage level to correspond to the level of a desired network.

In am embodiment, the autotransformer may include a regulating winding having a plurality of taps such that the selection of a tap along the regulating winding will refine the input voltage or the output voltage within the selected level. It may also include a tertiary winding and a cooling system.

DESCRIPTION OF THE DRAWINGS

To compliment the description being made and with the object of helping towards a better understanding of the characteristics of the invention, the following has been represented by way of non-limiting illustration.

DETAILED DESCRIPTION

Figure 1:
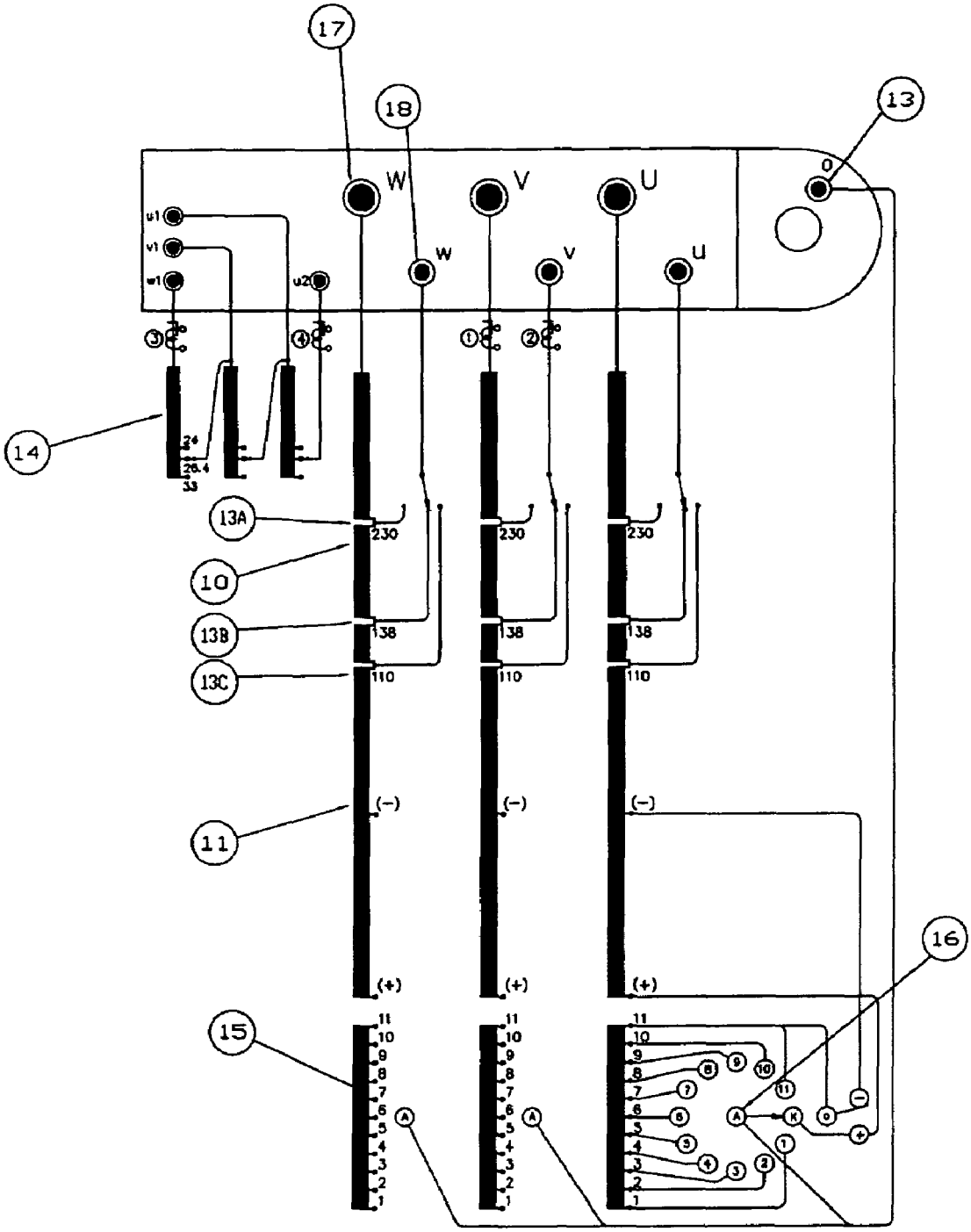
FIG. 1 represents an electric diagram of an exemplary multi-voltage power transformer's internal connections.

Before the present methods, systems and materials are described, it is to be understood that this disclosure is not limited to the particular methodologies, systems and materials described, as these may vary. It is also to be understood that the terminology used in the description is for the purpose of describing the particular versions or embodiments only, and is not intended to limit the scope.

It must also be noted that as used herein and in the appended claims, the singular forms "a," "an," and "the" include plural references unless the context clearly dictates otherwise. Thus, for example, reference to a "winding" is a reference to one or more classes and equivalents thereof known to those skilled in the art, and so forth. Unless defined otherwise, all technical and scientific terms used herein have the same meanings as commonly understood by one of ordinary skill in the art. Although any methods, materials, and devices similar or equivalent to those described herein can be used in the practice or testing of embodiments, the preferred methods, materials, and devices are now described. All publications mentioned herein are incorporated by reference. Nothing herein is to be construed as an admission that the embodiments described herein are not entitled to antedate such disclosure by virtue of prior invention.

As used herein, the term "high voltage" refers to voltages of approximately 69 kilovolts (kV) and higher. For example, high voltages may include voltages of approximately 69 kV to approximately 765 kV, approximately 115 kV to approximately 500 kV, approximately 72.5 kV to approximately 800 kV, approximately 121 kV to approximately 550 kV, and other ranges. In power transformers, such voltages may yield power ratings of approximately 100 MVA or higher, or other suitable voltage ratings.

A multi-voltage high voltage power transformer may be effective to combine the requirements of a spare unit for different input and/or output voltage levels. In addition, in some embodiments it may provide high power and an appropriate design to meet the requirements of railway transportation.

FIG. 1 shows an internal wiring diagram of an exemplary three-phase high voltage autotransformer. Each phase of the autotransformer includes a series winding 10, a common winding 11, and an optional regulating winding 15. Each series winding 10 may be electrically connected to a high voltage terminal 17 and a low voltage terminal 18. Each common winding 11 may be electrically connected to low voltage terminal 18 and a neutral terminal 13. Optionally, a regulating winding 15 may be positioned between the common winding 11 and the neutral terminal 13. The windings may be made of any suitable material, such as copper, insulated using a high dielectric strength paper lapping or other suitable material, and wound around any known core material such as magnetic steel in shell form or core form, using any suitable manufacturing method or material now or hereafter known to those of skill in the art.

Any desired number of taps may be positioned along one of the windings, both of the windings, or between the windings. For example, FIG. 1 shows an example where four taps 13A, 13B and 13C are located along the series winding 10 of each phase. For each tap, a wire may be present between each tap one or more of the terminals so that one or more of the taps may be connected to either the high voltage or low voltage terminal for that phase. Other tapping arrangements, such as busses, direct connections and other designs are possible within the scope of the invention, so long as multiple voltage levels may be selected to correspond to a desired network. The tap lead-to-bushing connections may be manually changed or equipped with a mechanical tap changing device.

For example, in the illustration of FIG. 1, if the desired network application requires a high voltage level of 400 kV and a low voltage level of 230 kV, the series winding may be connected directly to high voltage terminal 17, while tap 13A may be connected to the low voltage terminal 18. Alternatively, if the application requires a high voltage of 230 kV and a low voltage of 110 kV, tap 13A may be connected to high voltage terminal 17 and tap 13C may be connected to low voltage terminal 18. An example of the possible connections for the example of FIG. 1 is shown in the following table:

| Voltage ratio (HV/LV) | High voltage terminal connection | Low voltage terminal connection | Power rating |
|---|---|---|---|
| 400/230 kV | series winding | tap 13A | 450 MVA |
| 400/138 kV | series winding | tap 13B | 325 MVA |
| 400/110 kV | series winding | tap 13C | 260 MVA |
| 230/132 kV | series winding | tap 13A | 260 MVA |

As evidenced by the chart above, the "low voltage" terminals do not necessarily mean that the associated voltages are less than 69 kV, but rather that the low voltage terminal has a voltage that is less than that of the high voltage terminal.

Each phase may also include a regulating winding 15 that permits further refinement of the input and/or output voltages within the selected level. For example, referring to FIG 1, the regulating winding 15 has any number of taps that may be selected using a tap changer 16. The tap changer 16 may be any load or no-load tap changer now or hereafter known to those of skill in the art. By selecting a different position on the load tap changer, a small correction or other adjustment in input and/or output voltage may be made, without changing the overall input or output voltage level. Using the embodiment of FIG. 1 as an example, possible adjustments that may be made at various ratios include:

| Voltage ratio (HV/LV) | LTC Regulation |
|---|---|
| 400/230 kV | 230 kV +3.5%-3.8% |
| 400/138 kV | 138 kV +9%-9.8% |
| 400/110 kV | 110 kV +12.7%-13.5% |
| 230/132 kV | 132.3 kV +3.5%-3.8% |

Optionally, a programmable logic controller (PLC) may be employed to monitor conditions of the network and automatically operate the tap changer to correct for overvoltages or undervoltages as they occur. The PLC may also be programmed to allow parrallel interconnection with other autotransformers.

Because many autotransformers may not adequately suppress harmonic currents, a tertiary or delta winding 14 may be present to absorb at least some of the harmonic currents, stabilize the primary and/or secondary voltages, and/or provide grounding bank action. The tertiary winding may serve as a stabilizing winding as a countermeasure against high harmonics or as a power source for a substation. In an embodiment, the tertiary winding may also have different manually or mechanically selectable taps to allow for voltage level selection based on system conditions. Exemplary tertiary voltages and power ratings for a 230 kV connection in the example of FIG. 1 include:

| Tertiary Rated Voltage | Power rating |
|---|---|
| 19 kV | 34.5 MVA |
| 15 kV | 34.5 MVA |
| 13.8 kV | 34.5 MVA |

Figure 2:
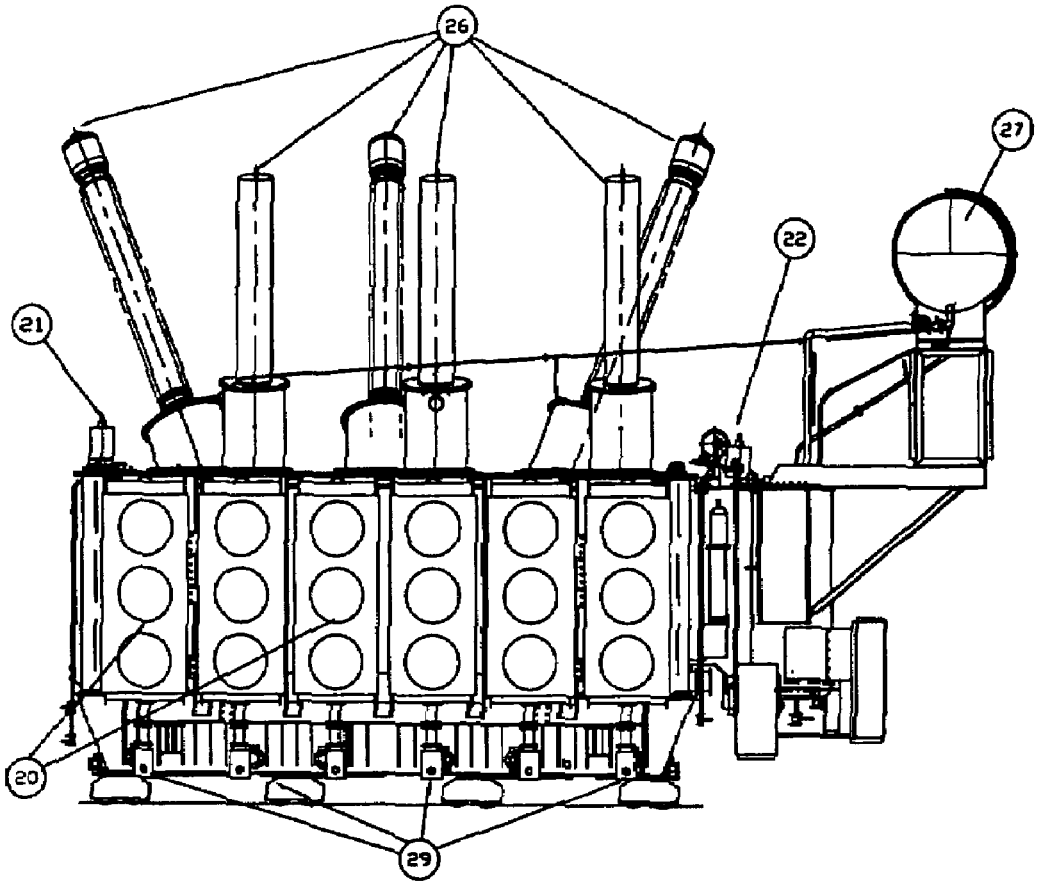
FIG. 2 shows a side view of an exemplary multi-voltage power transformer in operational mode, ready to be connected to a network.

In FIG. 2 there is a side view of an embodiment of a multi-voltage autotransformer, the autotransformer may include a number of high voltage and low voltage bushings 26 so there is a bushing for each series and common winding. One or more tertiary winding bushings 21 may also be provided. The bushings 26 and/or 21 will electrically connect the internal windings to the external network.

Any number of cooling devices 20 such as fans, heat exchangers and other items may be located along one or both sides of the autotransformer to provide forced-air ventilation of the windings and internal components. The cooling devices may maintain internal oil at a desired temperature, dissipating the transformer's internal energy loss. The cooling system may also include any number of pumps and motors 29 that force or otherwise deliver or radiate air and/oil through the internal cooling system. Although cooling devices 20 and pumps/motors 29 are optional, their use may permit development of a more compact requiring less internal space for heat dissipation. An oil tank 27 may store and preserve oil, and deliver it from or two the coil housing through a series of pipes and other conduits as necessary. Suitable oils may include mineral oil, synthetic hydrocarbons, dimethyl silicone, esters and other materials.

Figure 3:
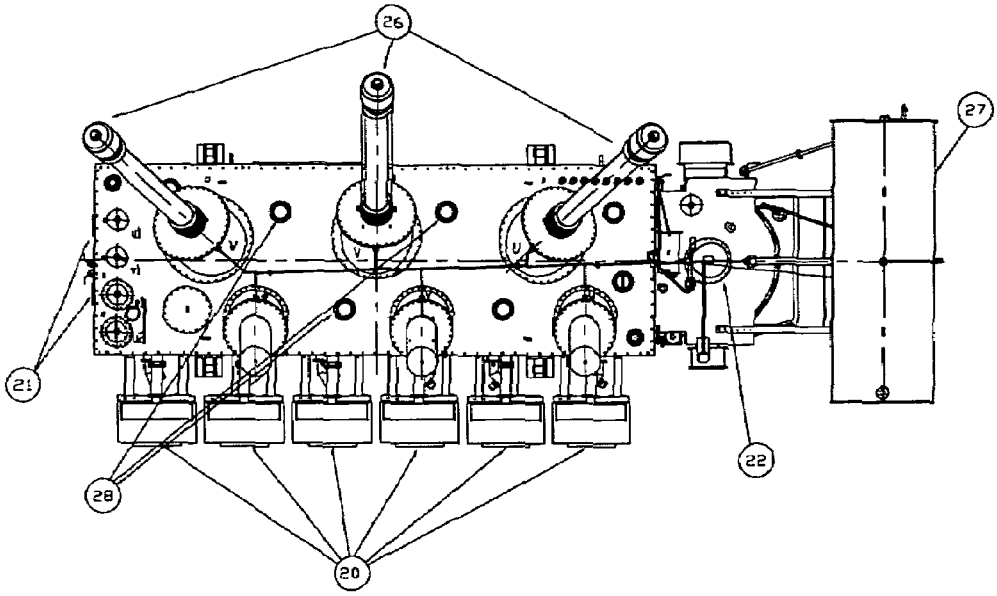
FIG. 3 represents a top view of an exemplary multi-voltage power transformer in operational mode.

Referring to the top view of FIG. 3, one can see that along with each bushing 26 there may be an associated access 28 such as a door or manhole wherein a user can access the tap leads and adjust the input and/or output voltage levels leading to each bushing. Such access points are optional, as in some embodiments the transformer housing may be large enough to permit a technician to enter the housing and make the change while the transformer is de-energized and drained. In such a case, only one access point is required.

Figure 4:
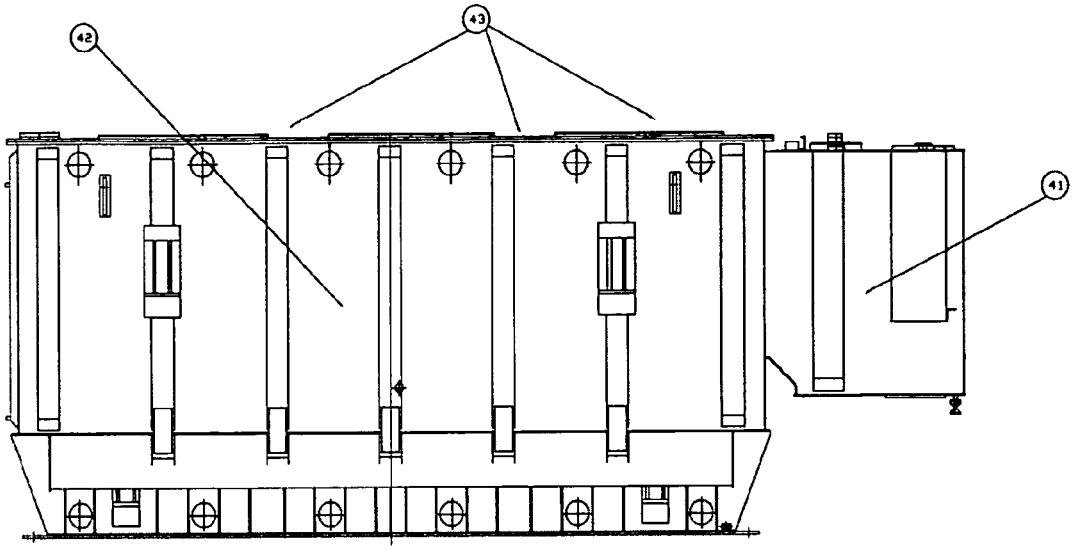
FIG. 4 shows a side view of an exemplary multi-voltage power transformer, in transportation mode, i.e. with the network connecting and cooling components disassembled.
Figure 5:
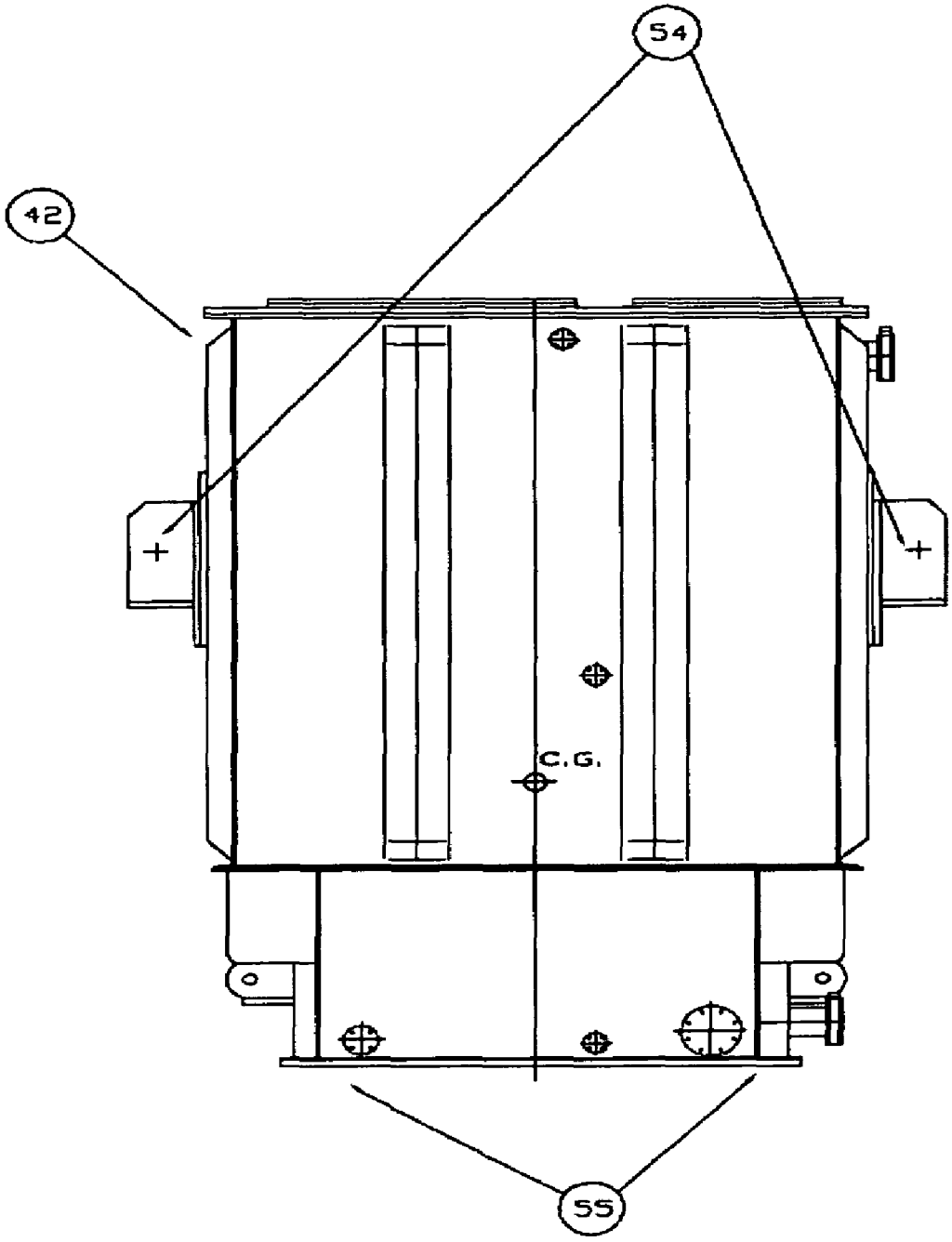
FIG. 5 shows a front view, in the same mode as that defined for FIG. 4.

FIG. 4 shows an exemplary high voltage multi-voltage autotransformer in shipment mode, with external components removed. For example, the bushings have been removed from the main body 42, and the bushing openings have covered with suitable covers 43 for shipment. A head side 41 may remain to hold the tap changer and/or other components. For shipment, the main body may be drained of oil and filled with dry air or another suitable material referring to FIG. 5, any number of wheels 55 and/or shipping gussets 54 may be conveniently positioned to allow for transporting and lifting the transformer.

In its transporting mode, the housing (i.e., the head side and central body with appropriate accessories removed) may have any suitable shipping dimensions and weights. Typically, such a weight may be about 100 metric tons and up. Such a size may include a length of about 6 meters and up, a width of about 2.5 meters and up, and a height of about 4 meters and up. Other sizes are possible. For example, in one embodiment such as that shown in FIGS. 3-5 a length may be about 11 meters, a height may be about 4.3 meters and a width may be about 3.2 meters. Other dimensions are possible so long as the unit will fit on a rail car or trailer for transportation by rail or highway in the relevant shipping location. For example, transport pads and/or shipping beams may increase a unit's overall transport width. Suitable weights may be any weights that rail or highway traffic may bear. For example, approximately 203,000 kg may be a suitable shipping weight in some transport locations.

In the upper portion, the bushing terminals are assembled which, during transportation and so as not to exceed the permitted dimensions, travel disassembled. Both the terminals position and that of the other accessories and tap changer means of operation and the different earth connections have been positioned so that they meet all the safety guarantees.

The structure of the different windings that comprise both the primary and secondary circuits of the transformer may be conveniently designed so that the input and/or output voltage can be set in accordance with the voltage level of the network to which it will be connected. The tertiary winding is also designed to be able to select different voltage levels.

The materials, accessories, form, size and arrangement of the components may vary, provided that this does not involve an alteration to the essential nature of the invention. The terms in which these embodiments have been described should be taken in the widest, non-limiting sense.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A multi-voltage autotransformer for interconnecting different high voltage power transmission systems comprising:

a series winding and a common winding both around a core;

a high voltage output terminal;

a low voltage output terminal;

a plurality of taps positioned along the series winding configured to selectably establish electrical connections between the series winding and at least one of the high voltage output terminal and the low voltage output terminal, and at least one additional tap positioned along the common winding configured to selectably establish an electrical connection between the common winding and at least one of the low voltage output terminal and a neutral output terminal, the plurality of taps and at least one additional tap configured so that any two of a plurality of different high voltage power transmission systems can be interconnected by the autotransformer; and a housing that holds the series winding, the common winding, the core and at least a portion of a cooling system;

wherein the housing is sized within a maximum dimension that is suitable for rail transport in a desired geographic area, and wherein the transformer has a power rating of at least about 100 MVA and an output voltage of at least about 69 kV.

2. The autotransformer of claim 1, wherein the autotransformer is a three-phase transformer comprising a series winding, common winding, high voltage output terminals, and low voltage output terminals, and one or more winding taps for each of three phases.

3. The autotransformer of claim 1, wherein the transformer is a single-phase transformer.

4. The autotransformer of claim 1 wherein the cooling system comprises oil and a plurality of heat exchangers that cool the oil.

5. The autotransformer of claim 1 further comprising a removable bushing for each high voltage terminal and each low voltage terminal.

6. The autotransformer of claim 1 further wherein the housing includes at least one access area that provides access to tap leads that permit selection of the taps.

7. The autotransformer of claim 1 further comprising a regulating winding and a tap changer that selects a tap position along the regulating winding.

8. The autotransformer of claim 1 further comprising a tertiary winding.

9. The autotransformer of claim 8 wherein the tertiary winding includes one or more taps that permit adjustment of tertiary winding voltage.

10. A multi-voltage, high voltage autotransformer comprising:

a series winding having a plurality of taps configured to selectably establish electrical connections between the series winding and at least one of a high voltage output terminal and a low voltage output terminal, wherein each tap corresponding to a different input voltage level determined by a transmission system connected thereto;

a common winding connected to the series winding and having at least one additional tap configured to selectably establish an electrical connection between the common winding and at least one of the low voltage output terminal and a neutral output terminal, wherein the at least one additional tap is further configured to provide an output voltage level;

a housing; and a plurality of removable components connected to the housing, wherein the autotransformer is sized to permit transport within applicable railway dimension and weight limitations when the removable components are removed from the housing.

11. The autotransformer of claim 10 wherein the removable components include at least one high voltage input bushing and at least one high voltage output bushing.

12. The autotransformer of claim 10 where the autotransformer has a power rating of at least about 100 MVA and an output voltage of at least about 69 kV.

13. The autotransformer of claim 10 further comprising a regulating winding having a plurality of taps such that the selection of a tap along the regulating winding will refine the input voltage or the output voltage within the selected input voltage level or output voltage level.

14. The autotransformer of claim 10 further comprising a tertiary winding.

15. The autotransformer of claim 10 further comprising a cooling system comprising oil and a plurality of heat exchangers that cool the oil.

16. A multi-voltage autotransformer for interchangeably interconnecting a plurality of high voltage transmission systems, comprising:

a series winding electrically connected to a first high voltage terminal and a first low voltage terminal, the series winding having a first plurality of taps configured to selectably establish electrical connections between the series winding and at least one of a high voltage output terminal and a low voltage output terminal;

a common winding electrically connected to a second low voltage terminal and a neutral terminal, the common winding having at least one additional tap configured to selectably establish an electrical connection between the common winding and at least one of the low voltage output terminal and a neutral output terminal;

a second plurality of taps positioned along the common winding and electrically connected to the second low voltage terminal; and a housing that contains the series winding, common winding, and taps;

wherein selection of any of the taps changes the output voltage of the autotransformer to enable interconnection of the autotransformer to a different high voltage transmission system.

17. The autotransformer of claim 16, wherein the housing will fit on a rail car or trailer for transportation by rail or highway in a relevant shipping location.

18. The autotransformer of claim 16 further comprising a cooling system that is also at least partially contained within the housing.

19. The autotransformer of claim 16 further comprising at least one tap positioned along the series winding and electrically connected to either the first high voltage terminal or the first low voltage terminal.

20. The autotransformer of claim 16 further comprising a regulating winding contained within the housing, the regulating winding having a plurality of taps such that the selection of a tap along the regulating winding will refine an input voltage or output voltage within a selected voltage level.

21. The autotransformer of claim 16 further comprising at least one bushing that is removably attached to an exterior portion of the housing.

* * * * *